US010450812B2

(12) United States Patent
Van Der Loos et al.

(10) Patent No.: US 10,450,812 B2
(45) Date of Patent: Oct. 22, 2019

(54) ROD HANDLER IMPROVEMENTS

(71) Applicant: SANDVIK INTELLECTUAL PROPERTY AB, Sandviken (SE)

(72) Inventors: Jacob Van Der Loos, Queensland (AU); William Howard, Queensland (AU); Robert Frith, Queensland (AU); Patrick Meehan, Queensland (AU); Sean Laird, Queensland (AU); Tim Renton, Queensland (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 80 days.

(21) Appl. No.: 14/650,977

(22) PCT Filed: Dec. 11, 2013

(86) PCT No.: PCT/AU2013/001440
§ 371 (c)(1),
(2) Date: Jun. 10, 2015

(87) PCT Pub. No.: WO2014/089615
PCT Pub. Date: Jun. 19, 2014

(65) Prior Publication Data

US 2015/0315854 A1 Nov. 5, 2015

(30) Foreign Application Priority Data

Dec. 11, 2012 (AU) ..... 2012905435

(51) Int. Cl.
*E21B 19/06* (2006.01)
*E21B 19/15* (2006.01)
*E21B 7/02* (2006.01)

(52) U.S. Cl.
CPC ..... *E21B 19/06* (2013.01); *E21B 7/02* (2013.01); *E21B 19/155* (2013.01)

(58) Field of Classification Search
CPC ..... E21B 19/10; E21B 19/102; E21B 19/20; E21B 19/087
See application file for complete search history.

(56) References Cited

U.S. PATENT DOCUMENTS 1,966,454 A * 7/1934 Moody ..... E21B 19/10 188/67
3,096,075 A * 7/1963 Brown ..... E21B 19/00 166/77.4

(Continued)

FOREIGN PATENT DOCUMENTS

CA 2306306 A1 4/2001
DE 2400148 A1 7/1975

(Continued)

*Primary Examiner* — Nicole Coy
*Assistant Examiner* — Jonathan Malikasim
(74) *Attorney, Agent, or Firm* — Corinne R. Gorski

(57) ABSTRACT

A handler for drill rods, a drill rod support thereof, a method of operation for the handler, and a drill rig employing the handler and the drill rod support is provided. The drill rod support includes a socket configured to receive a portion of a length of a drill rod, and a clamping device disposed within the socket and movable between clamping and release positions with respect to the drill rod.

7 Claims, 11 Drawing Sheets

(56) References Cited

U.S. PATENT DOCUMENTS

| | | | | |
|---|---|---|---|---|
| 4,306,339 | A * | 12/1981 | Ward | E21B 19/10 188/67 |
| 4,418,556 | A | 12/1983 | Galle et al. | |
| 5,992,801 | A | 11/1999 | Torres | |
| 7,537,421 | B2 | 5/2009 | Puzio et al. | |
| 7,537,424 | B2 * | 5/2009 | Innes | E21B 7/02 211/70.4 |
| 7,607,866 | B2 * | 10/2009 | Eddowes | E21B 19/086 211/70 |
| 2009/0095489 | A1 | 4/2009 | Roodenburg et al. | |
| 2009/0121507 | A1 | 5/2009 | Willis | |
| 2010/0200221 | A1 | 8/2010 | Sipos | |
| 2011/0232919 | A1 | 9/2011 | Snider et al. | |

FOREIGN PATENT DOCUMENTS

| | | | |
|---|---|---|---|
| GB | 424557 | A | 2/1935 |
| GB | 2014215 | A | 8/1979 |
| SU | 325340 | | 1/1972 |
| SU | 549569 | | 3/1977 |
| SU | 1738998 | | 6/1992 |
| WO | 95/04868 | A1 | 2/1995 |

* cited by examiner

ROD HANDLER IMPROVEMENTS

PRIORITY DOCUMENT

Related Application Data

This application is a § 371 National Stage Application of PCT International Application No. PCT/AU2013/001440 filed Dec. 11, 2013 claiming priority of Australian Provisional Patent Application No 2012905435 titled "ROD HANDLER IMPROVEMENTS" filed on 11 Dec. 2012. The content of this application is hereby incorporated by reference in its entirety.

TECHNICAL FIELD

The present invention relates to a handling means for drill rods, a drill rod support thereof, a method of operation for the handling means, and a drill rig employing the handling means and the drill rod support.

BACKGROUND

Drill rigs for drilling bore holes generally comprise an upstanding mast supporting a drill head which is movable along the mast. The drill head is provided with means which can receive and engage the upper end of a drill rod forming part of a drill string to drive the drill string and drill bit mounted to the lower end of the drill string. In addition, the drill head may have means for applying a downward force to the drill string to facilitate penetration.

The drill string comprises a number of lengths of drill rod which are connected end to end, where the length of drill rod generally is at the most equal to the height of the mast. During a drilling operation when the drill head has reached the lower end of the mast, the drill string is retained to the mast and the drill head is disconnected from the drill string and raised to the upper end of the mast. A fresh length of drill rod is then raised and positioned in the chuck of the drill head and then the lower end becomes engaged with the upper end of the drill string. Once the fresh length of drill rod has been put in place, the drilling operation can recommence until the drill head again reaches the lower end of the mast. During drilling activities which may extend for hundreds of meters, it is necessary to locate fresh lengths of drill rod into a drill string at very regular intervals.

Throughout this specification the term "drill rod" should be construed as including all forms of elongate members used in the drilling, installation and maintenance of bore holes and wells in the ground, and will include rods, pipes, tubes and casings which are provided in lengths and are interconnected for use in the borehole.

In practice however, not all drill rods are the same, they differ significantly. For instance, rods for diamond core drilling (hereinafter diamond rods) are much lighter and more delicate than rods for reverse circulation drilling (hereinafter RC rods), particularly at the threads, so a means suitable for handing RC rods is generally unsuitable for handling diamond rods, and vice versa.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

In a first aspect the present invention accordingly provides a drill rod support for a means for handling drill rods, the support defining a socket configured to receive a portion of a length of a drill rod, and clamping means disposed within the socket and movable between clamping and release positions with respect to the drill rod.

In one form, the clamping means comprises at least one movable portion, or jaw.

In one form, the clamping means comprises a plurality of jaws arranged radially about the socket.

In one form, the clamping means comprises three radially equi-spaced jaws.

In one form, the socket, and the or each jaw, is elongate, each having a substantially parallel direction of elongation to the other.

In one form, the clamping means is self-centering, and as such always clamps the rod centrally with respect to the socket.

In an alternative, the clamping means may comprise one or more bands for encircling the drill rod and tightening about this.

In one form, the support further comprises drive means for the clamping means. In one form, the drive means comprises one or more actuators. In one form, the or each actuator drives the clamping means via a transmission system. In one form, in an alternative, the or each actuator drives the clamping means directly.

In one form, the clamping means is biased towards its release position by biasing means, so the drive means need only drive the clamping means into its clamping position. In one form, the biasing means comprises a spring device or element.

In one form, the drive means comprises a linear actuator which drives a jacking plate against the bias of the biasing means, the drill rod support further comprising a floating plate which will follow the jacking plate by virtue of being linked to the jacking plate by at least one connecting rod, the or each movable jaw following the floating plate by virtue of being operatively associated with this, and wherein the or each movable jaw is moved into its clamping position as it is driven against the bias of the biasing means.

In one form, the or each movable jaw comprises a guide follower operatively associated with a jaw guide disposed in the socket to drive the jaw into its clamping position as it is driven against the bias of the biasing means.

In one form, each guide follower comprises an inclined plane which will slide smoothly against an oppositely directed but similarly inclined plane of the jaw guide with any longitudinal movement driven by the linear actuator.

In one form, the drill rod support further comprises an elongate cylindrical housing defining the socket internally, where one end of the housing is open, and an opposing end is substantially closed by an end plate from which there depends the linear actuator.

In one form, the biasing means comprises a compression spring disposed over each of the connecting rods and between the end plate and the floating plate so as to maintain a predetermined spacing between these In a further aspect, the invention may be said to reside in a drill rod support for a means for handling drill rods, the support comprising at least a pair of elongate jaws, at least one of which is movable between clamping and release positions with respect to a drill rod so that a full length of each jaw clamps the rod along its longitudinal axis when in the clamping position.

In a further aspect, the invention may be said to reside in a handling means for drill rods comprising a base, a drill rod support as described above, wherein the drill rod support depends from the base so as to so movable with respect to the base as to effect transfer of a length of drill rod from a drill rod storage position, to a position in line with a drill string, and vice versa.

In one form, the drill rod support depends from the base so as to rotatable about an axis transverse to a longitudinal axis of the drill rod support whereby the support can be moved between an upright position and a substantially horizontal position, as well as movable between a first position located adjacent the drill rod storage position and one or more positions clear of the first position, including the position in line with the drill string.

In one form, the socket is defined by a housing having an open end through which the drill rod is receivable and a closed end in opposed relation to the open end, said closed end being lowermost when the drill rod support is in its substantially upright position.

In one form, the direction of elongation of the socket extends between the open and closed ends of the housing.

In one form, the drill rod support depends from an arm which is rotatably supported from the base for rotation about a substantially upright axis.

In a further aspect, the invention may be said to reside in a drill rig comprising a handling means as described above.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

In order to further understand the invention, preferred embodiments, will now be described. However, it will be realised that the scope of the invention is not be confined or restricted to the details of the embodiments described below. Variations and alterations that would be readily apparent to a person skilled in the art are deemed as being incorporated within the scope of the invention.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
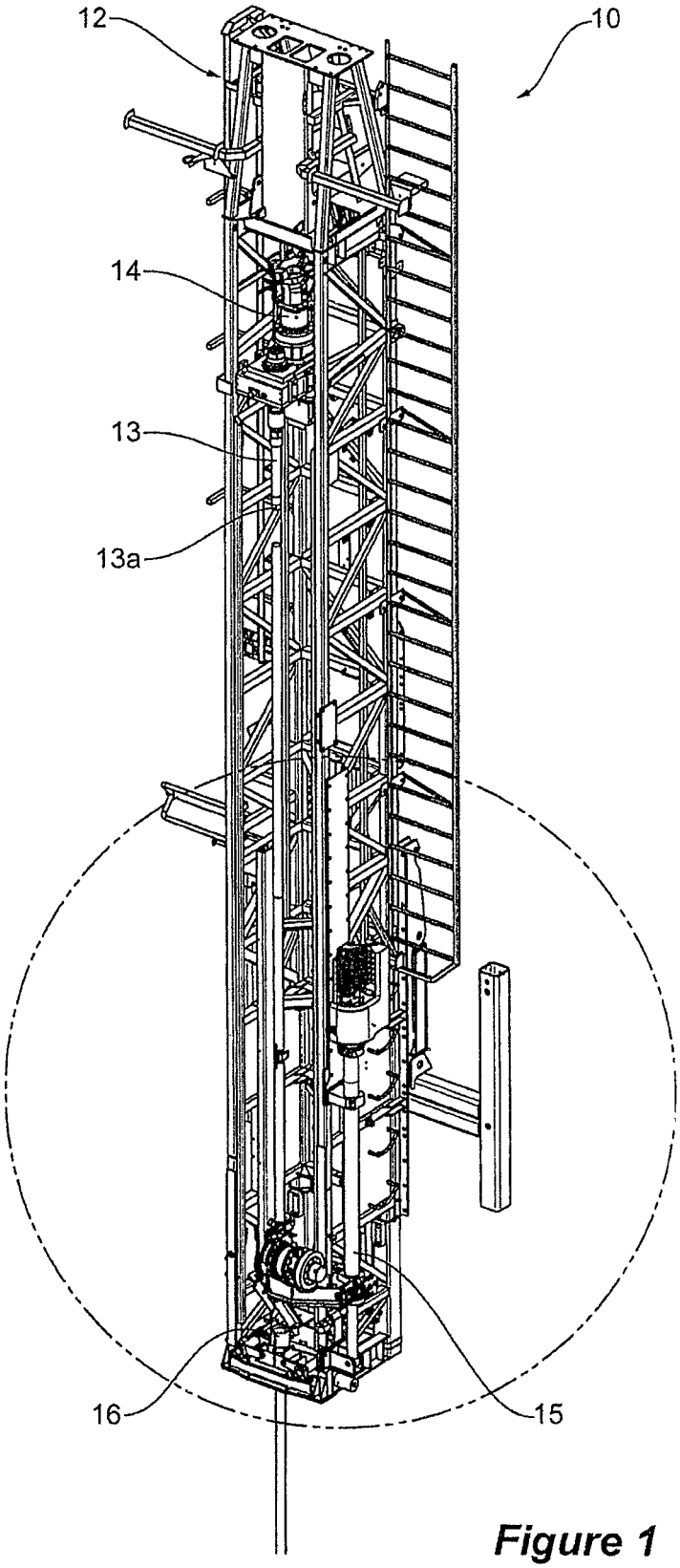
FIG. 1 is an isometric view of a drill mast for a drilling rig.

Referring now to FIG. 1, where there is illustrated a drill rig 10 for support by a vehicle (not shown) and comprising a mast 12 which can be pivoted between an upright operative position as shown in the drawings, and a horizontal position (not shown), in which it lies along a substantially central axis of the vehicle to facilitate transportation.

Optionally the drill rig 10 can be configured so that it can be transported by a vehicle and then left in a stationary position when de-coupled from the vehicle.

The drill mast 12 supports a drill head 14 which, in use, drives the drill string (not illustrated) rotationally via a drive motor accommodated in the drill head 14, as well as driving the drill string into and out of a bore hole via a feed system.

The drill rig 10 comprises a drill rod handling means which is intended to simplify the transfer of a drill rod from a storage bin to a position in line with the drill string, in which the drill rod can be engaged with the drill head 14 at its upper end and engage with the drill string at its lower end, and to also simplify the removal of a length of drill rod from a drill string.

The drill rod handling means can be incorporated into a drill rig 10 either as an attachment or as an integral part of the drill rig.

Figure 2:
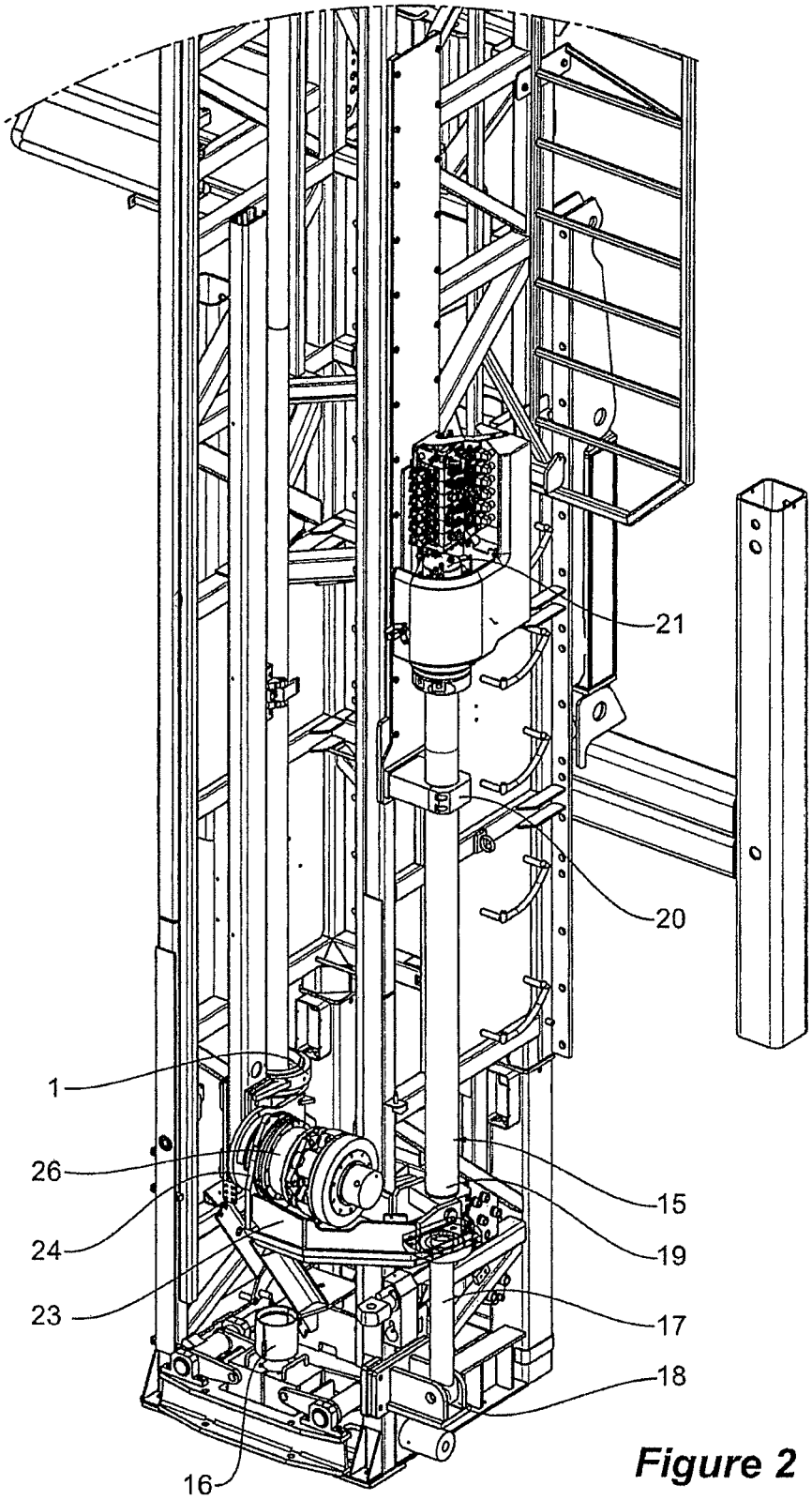
FIG. 2 is a detail view of a lower end of the drill mast of FIG. 1.
Figure 4:
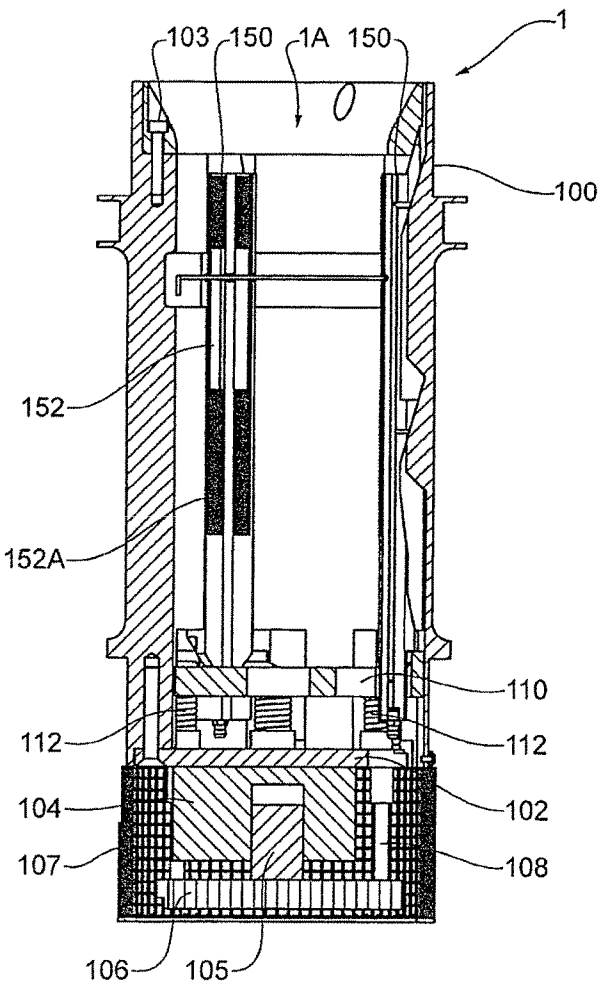
FIG. 4 is a cross-sectional view through the rod support of FIG. 3.
Figure 3:
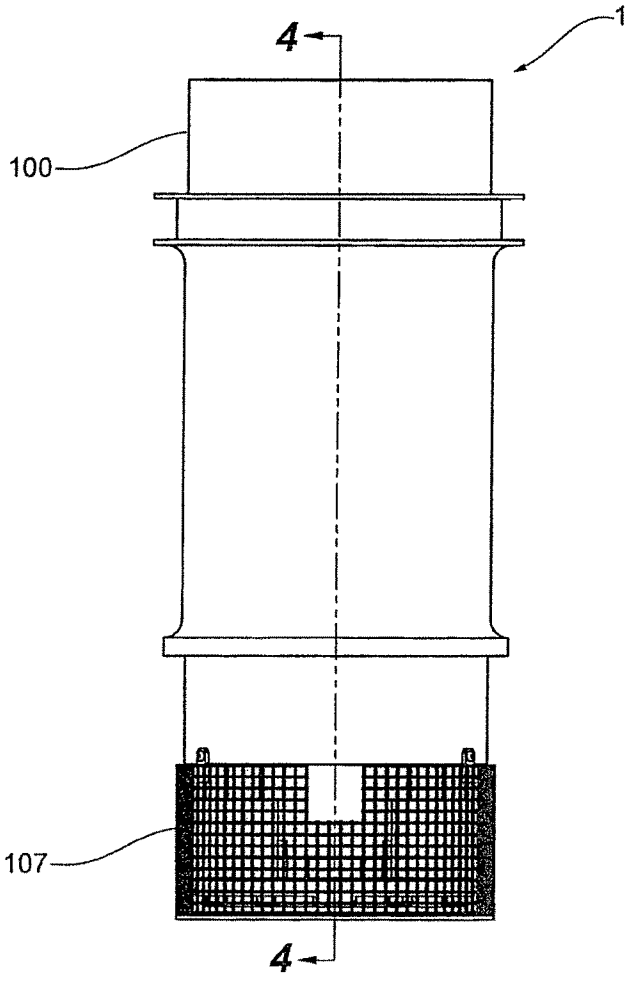
FIG. 3 is a side view of a rod support from the drill mast of FIG. 1.
Figure 7:
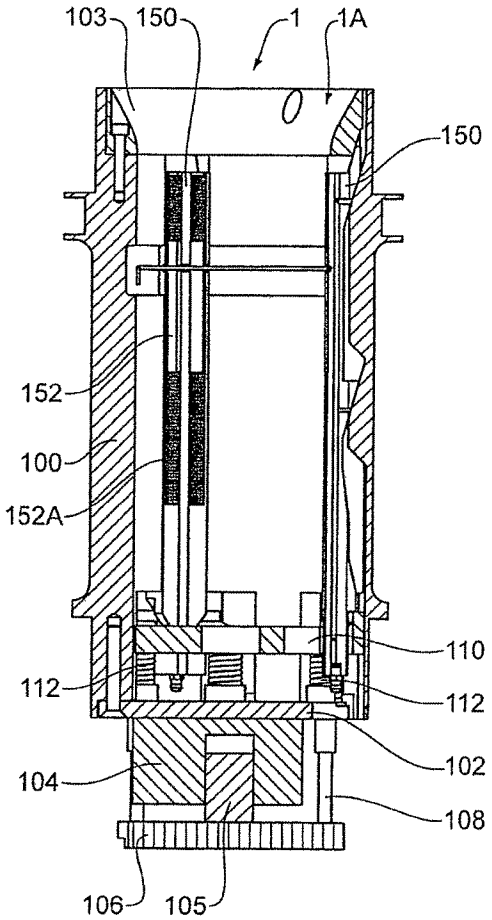
FIG. 7 is a cross-sectional view through the rod support of FIG. 5.
Figure 6:
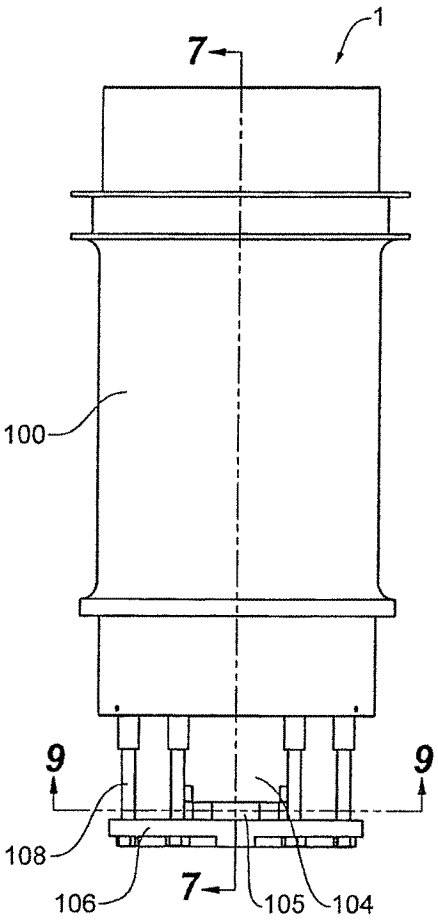
FIG. 6 is a side view of the rod support of FIG. 5.
Figure 5:
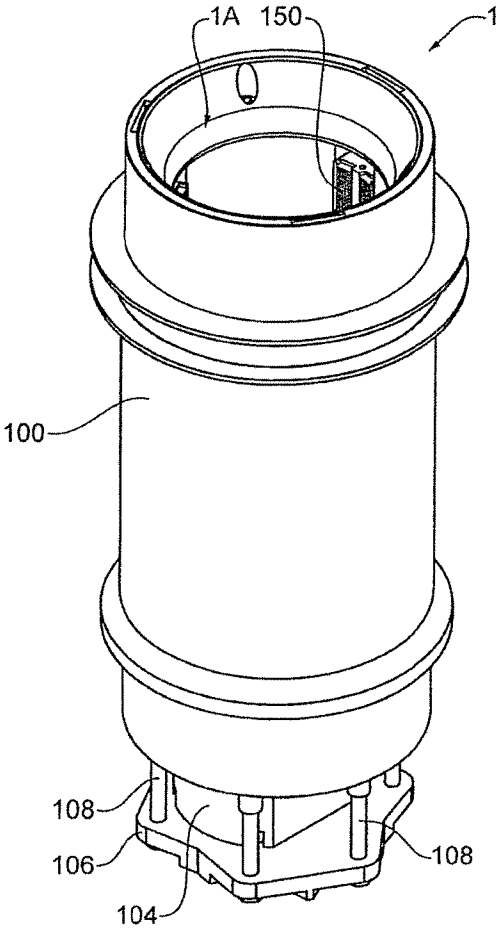
FIG. 5 is an isometric view of the rod support of FIG. 1, minus a guard cage for the jack and jacking plate.
Figure 8:
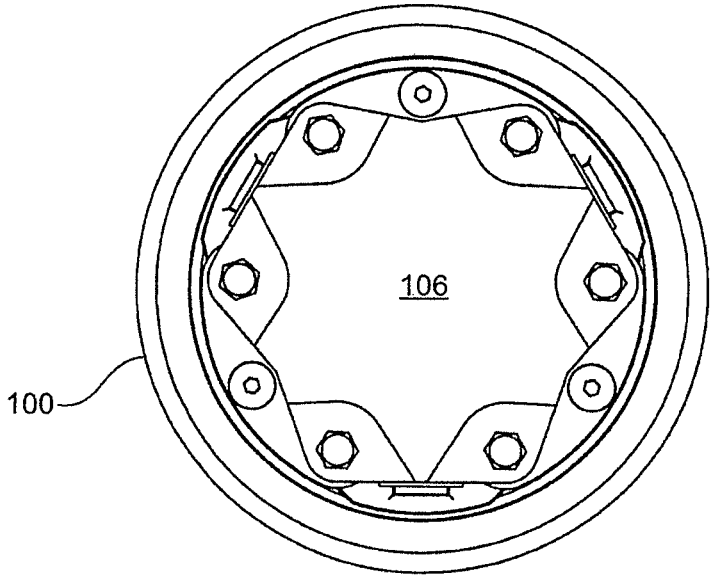
FIG. 8 is an end view of the rod support of FIG. 5.
Figure 9:
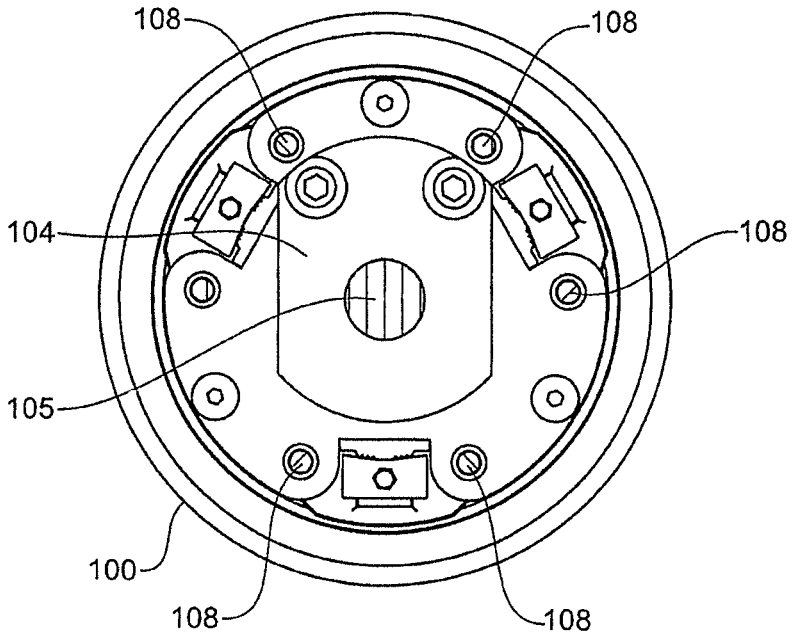
FIG. 9 is a cross-sectional view through the connecting rods of the rod support of FIG. 5.

Referring now to FIG. 2, wherein, in the illustrated embodiment the drill rod handling means comprises a linear actuator 15 which is supported to one side of the drill mast 12 clear a front face of the drill mast 12. The linear actuator 15 comprises an upstanding shaft 17 which is substantially parallel to the main axis of the drill mast, one end 18 of which is fixed to a base of the mast. The other end of the shaft 17 is received within a closed cylinder 19 and is provided with a seal whereby the space defined between the seal and each end of the cylinder 19 comprises a separate enclosed space. The cylinder 19 is slideably received within a support block 20 mounted to the side of the drill mast which facilitates longitudinal displacement of the cylinder 19 through the support block 20. The enclosed spaces within the cylinder 19 are connected to a source of fluid pressure whereby the displacement of the cylinder along the shaft 17 can be controlled to cause the cylinder 19 to move upwardly or downwardly with respect to the drill mast 12 through the support block 20.

The upper end of the cylinder 19 has a first rotary actuator 21 mounted to it whereby the drive shaft of the first rotary actuator 21 is mounted to the cylinder 19 while the body of the first rotary actuator 21 is supported in such a way as to prevent relative rotation between the body thereof and the mast 12, but which will permit longitudinal displacement there between. As a result, the cylinder 19 is capable of being turned about its central axis through the action of the first rotary actuator 21 and is capable of being displaced upwardly and downwardly with respect to the drill mast by the linear actuator 15.

The lower end of the cylinder 19 is provided with a radial arm 23 which is provided at its outer end with an upstanding support plate 24 which is generally tangential to the radial axis of the cylinder 19. The support plate 24 rotatably supports a drill support 1 which is rotatable about an axis which is transverse to the central axis of the cylinder 19. The rotation of the drill rod support 1 is controlled by means of a second rotary actuator 26 which takes the form of a hydraulic motor and which controls the rotation of the drill rod support 1 on the support plate 24 about its axis of rotation.

Referring now to FIGS. 3 through 20, where it can be seen that the drill rod support 1 comprises an elongate cylindrical housing 100 defining a generally tubular socket 1A internally. One end of the housing 100 is open, and an opposing end is closed by an end plate 102 bolted to the housing 100. Extending around an opening to the socket 1A is a tapered guide ring 103 shaped to guide the end of a drill rod into the socket 1A.

Secured to an outer-side of the end plate 102 is an hydraulically powered jack 104 (drive means) having a piston rod 105 which bears against, and thereby drives, a jacking plate 106. The jack 104 and the jacking plate 106 are enclosed by a guard cage 107.

From the jacking plate 106 there extends a plurality of connecting rods 108, which extend through apertures 103 (see FIG. 9) in the end plate 102 to a floating plate 110 disposed within the socket.

Disposed over each of the connecting rods 108 and between the end plate 102 and the floating plate 110 is a compression spring 112 biased to maintain a predetermined spacing between these.

A jaw 150 locates in each one of a set of three radially equi-spaced jaw slots 140 (clamping means) formed into an inner wall of the housing 100, and each of the jaws 150 is keyed to the jacking plate 106 and so follows the movement of this. These jaws 150 can be replaced once worn, and are interchangeable for instances where specially adapted jaws are required for certain types or sizes of drill rod.

Figure 12:
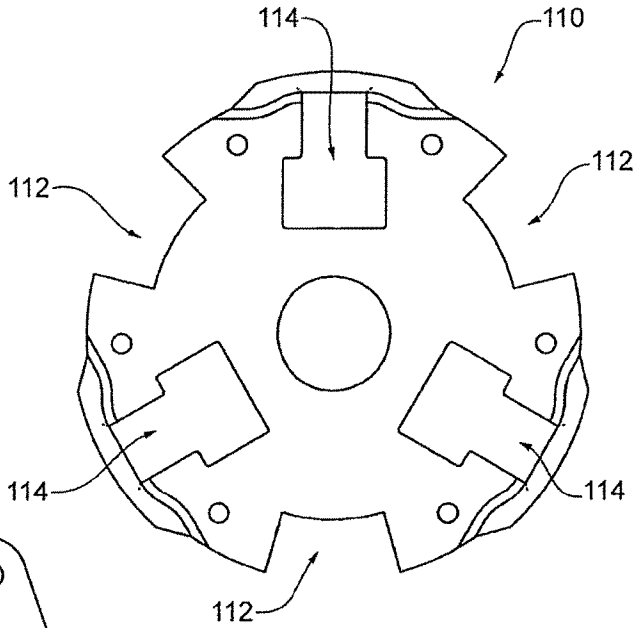
FIG. 12 is a plan view of a floating plate from the rod support of FIG. 5.
Figure 10:
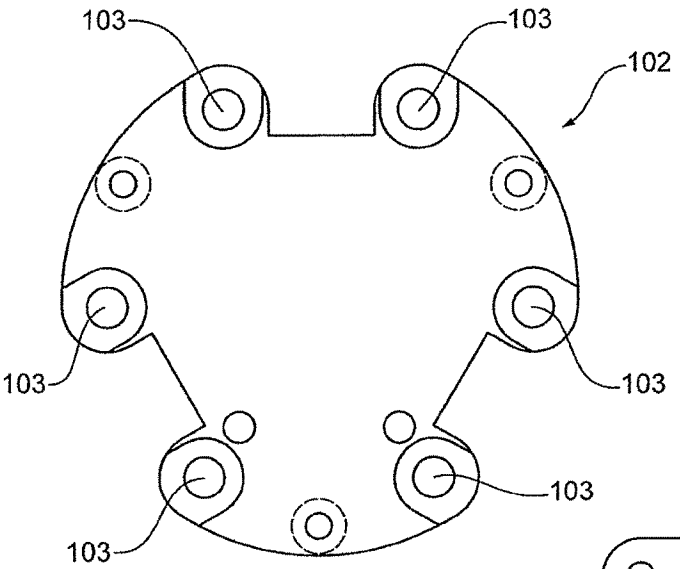
FIG. 10 is a plan view of an end plate from the rod support of FIG. 5.
Figure 11:
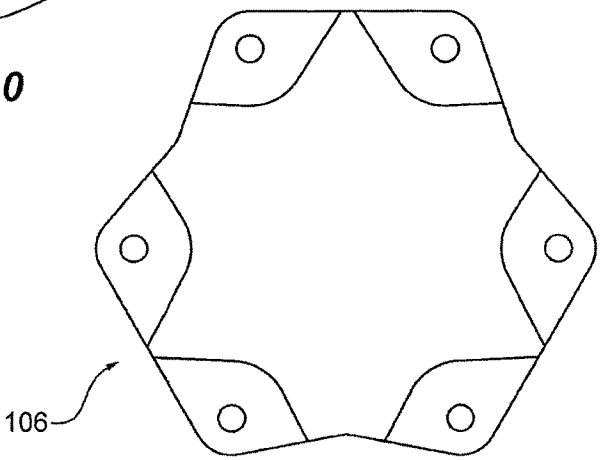
FIG. 11 is a plan view of a jacking plate from the rod support of FIG. 5.

Referring now to FIG. 12, where it can be seen that the floating plate 110 comprises a set of three radially equi-spaced guide slots 112, and a set of three radially equi-spaced, T-shaped retaining slots 114, the purpose of all of which will be discussed in greater detail below.

Figure 14:
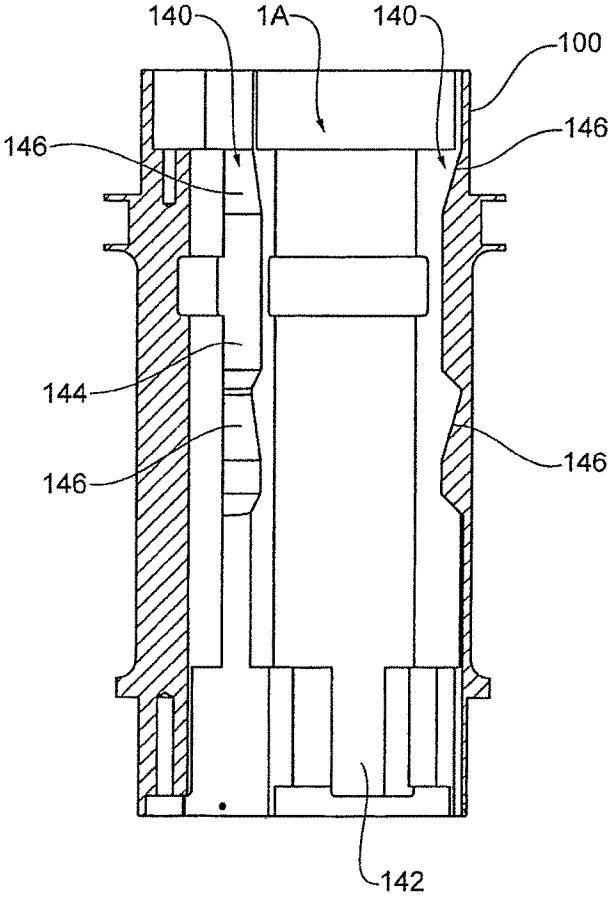
FIG. 14 is a cross-sectional view through the housing of FIG. 12.
Figure 13:
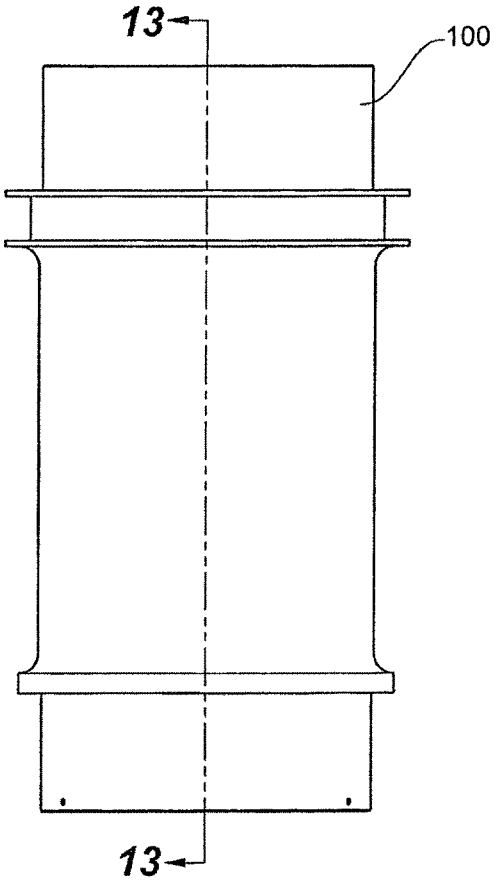
FIG. 13 is a side view of a housing from the rod support of FIG. 5.
Figure 18:
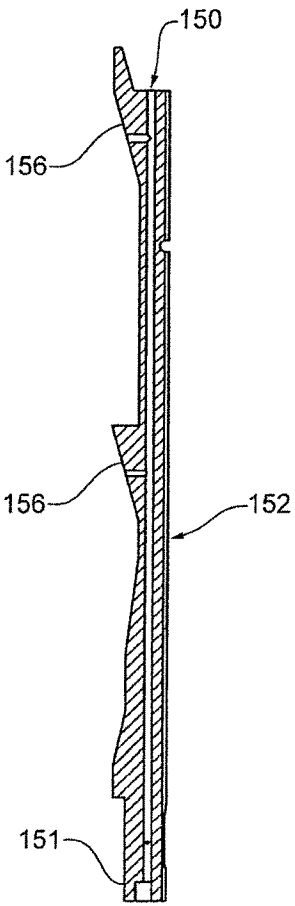
FIG. 18 is cross-sectional view through the jaw of FIG. 15.
Figure 17:
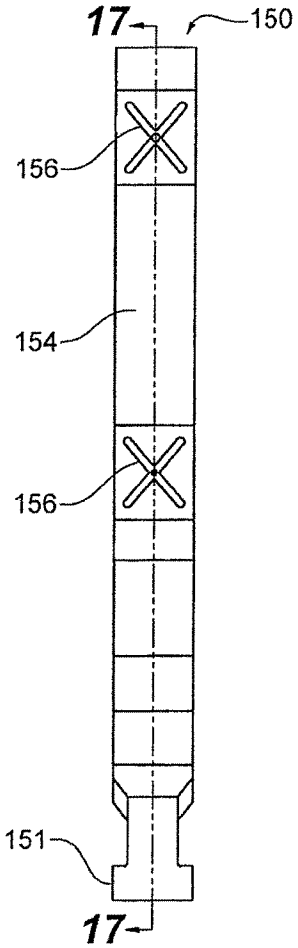
FIG. 17 is view of a guide following face (opposite to the gripping face) of the jaw of FIG. 15.
Figure 16:
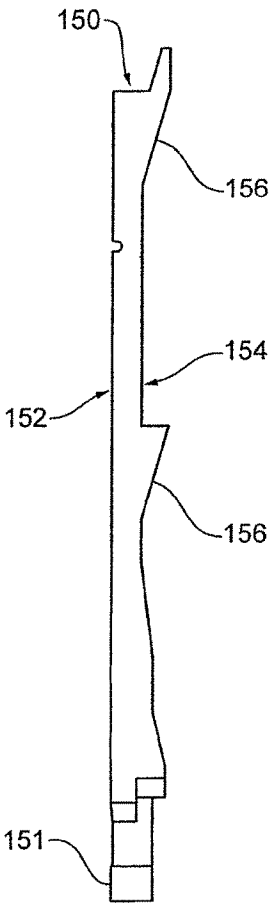
FIG. 16 is a side view of the jaw of FIG. 15.
Figure 15:
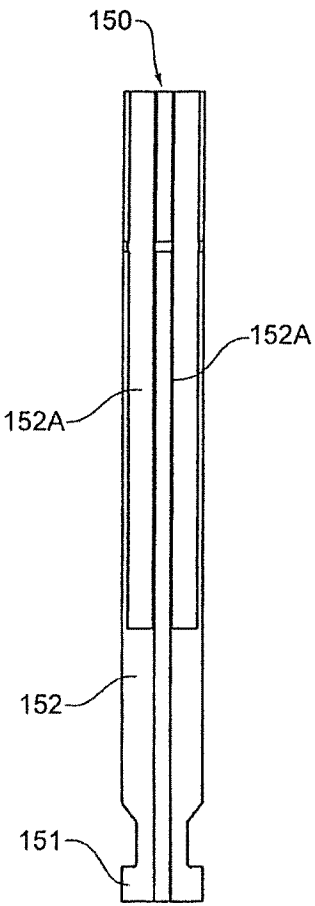
FIG. 15 is a view of a gripping face of a jaw from the rod support of FIG. 5.
Figure 19:
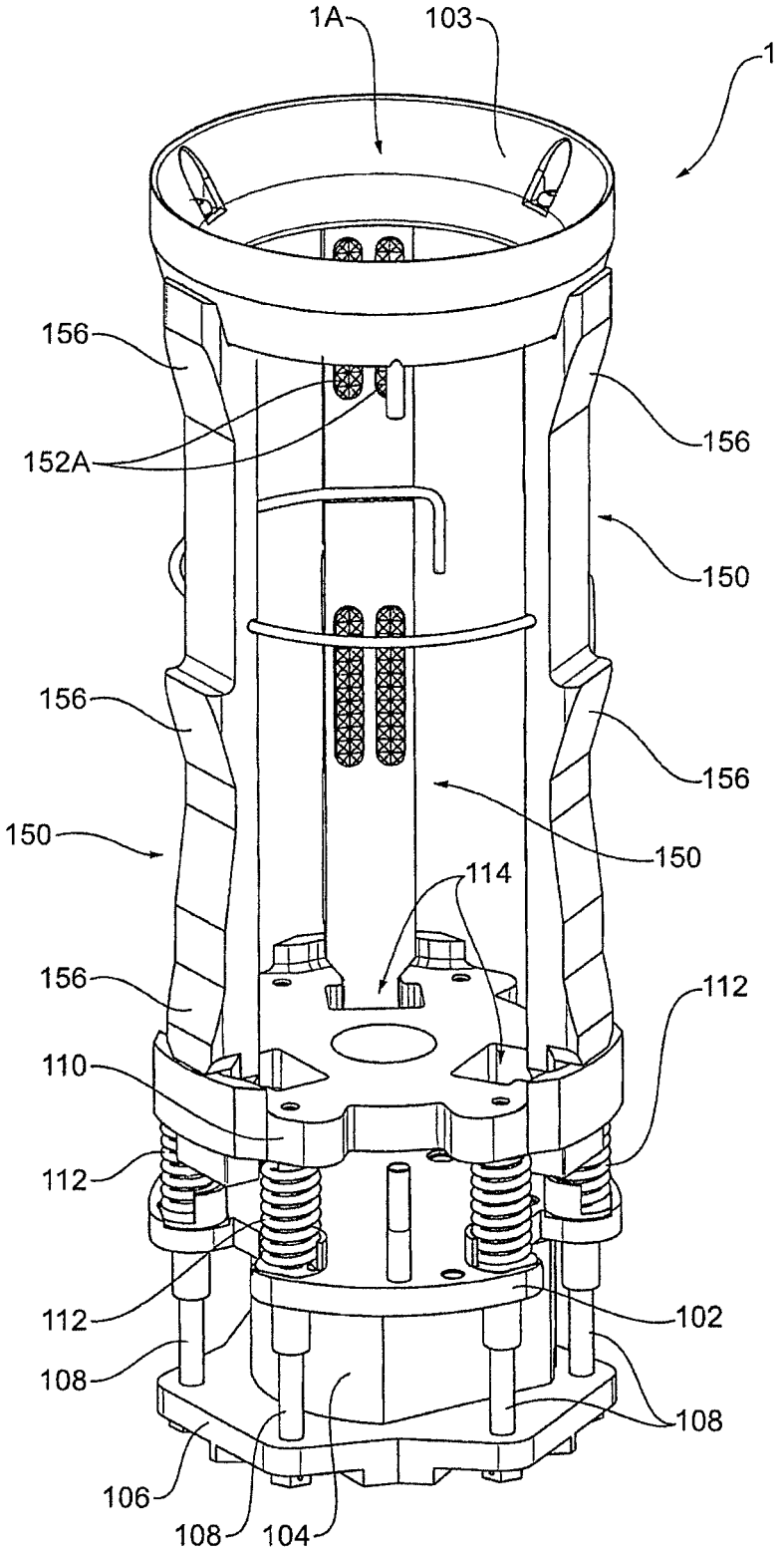
FIG. 19 is an isometric view of the rod support of FIG. 1, minus the housing and guard cage, which are removed for improved visibility of the internal assembly.

Referring now FIG. 14, where it can be seen that the socket 1A defined by the housing 100 is generally circular in cross-section, with the exception that this comprises the set of three radially equi-spaced jaw slots 140, and a set of three radially equi-spaced guide splines 142.

The guide splines 142 are elongate splines extending lengthwise along the inner wall of the housing 100. The guide splines 142 extend from the closed end of the housing 100 and end where the jaw slots 150 begin. In use, for each guide spline 142 there is a guide slot 112 in the floating plate 110 which will run along the guide spline 142 with a sliding fit.

The jaw slots 140 are elongate slots extending lengthwise along the inner wall of the housing 100. One of the jaws 150 will locate in each of these jaw slots 140.

Each of the jaw slots 140 comprise a pair of side walls separated by a floor. Each floor comprises a lengthwise extending jaw guide 144, where this jaw guide 144 is characterised by a pair of substantially identical but longitudinally spaced apart inclined planes 146. The purpose of these jaw guides 144 and the inclined planes 146 will be described in greater detail below.

Referring now to FIGS. 15 through 18, where it can be seen that each of the jaws 150 comprises a T-shaped head portion 151 which is engaged with one of the T-shaped retaining slots 114 in the floating plate 110, so that in use, each of the jaws 150 follows the movement of the floating plate 110.

Each of the jaws 150 further comprises a gripping face 152 (with carbide inserts 152A), and an oppositely directed guide follower 154 characterised by a pair of substantially identical but longitudinally spaced apart inclined planes 156. Once assembled, the inclined planes 156 of the guide follower 154 will bear against the oppositely directed but similarly inclined planes 146 of the jaw guides 144 in the housing 100, and slide smoothly against these with any longitudinal movement driven by the floating plate 110.

This smooth sliding action will be assisted by grease supplied via journals extending through the jaws 150.

Figure 20:
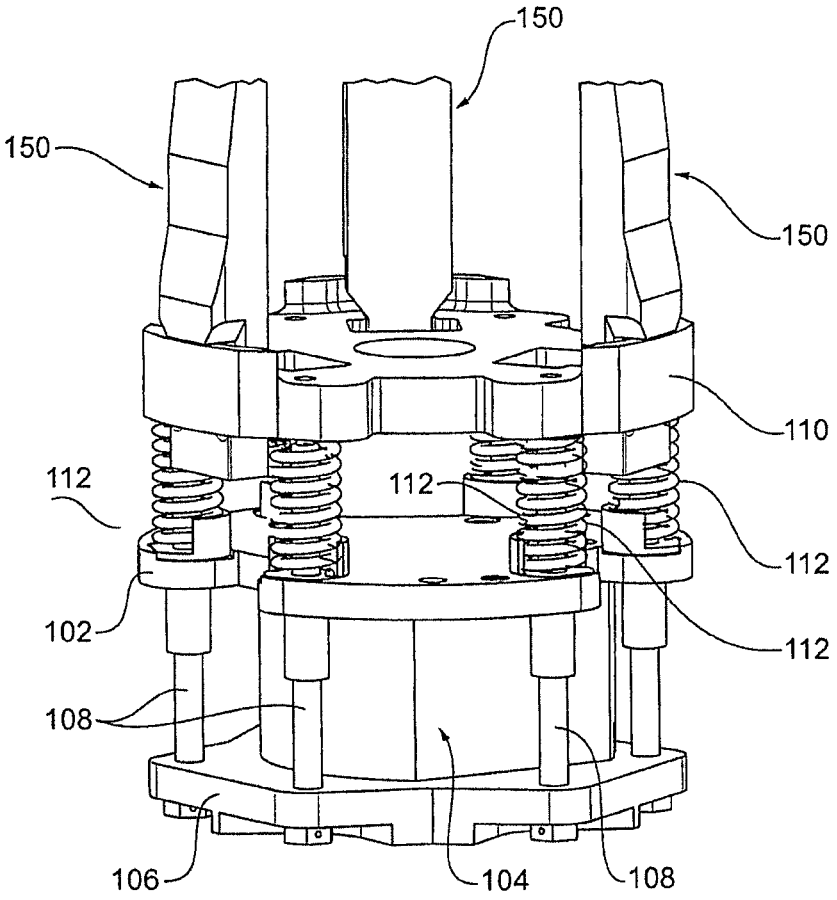
FIG. 20 is a drive end view of the rod support internals of FIG. 19, illustrating all of the moving components in a rod release position.
Figure 21:
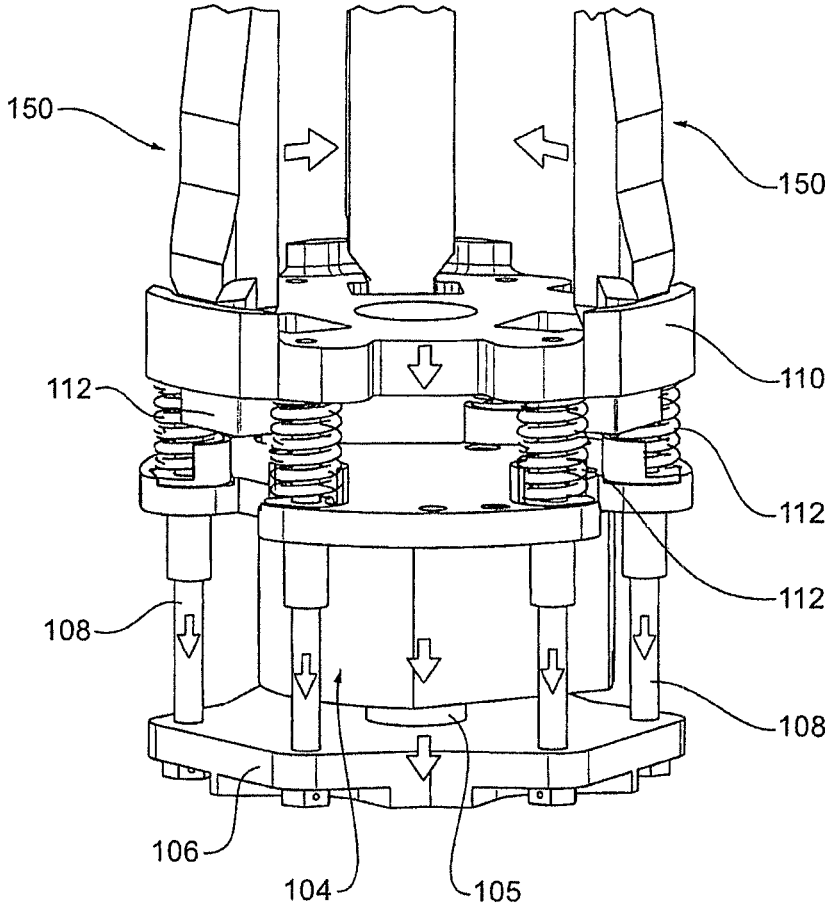
FIG. 21 is a drive end view of the rod support internals of FIG. 19, illustrating all of the moving components in a rod gripping position.

Referring now to FIGS. 20 and 21, where it can be seen how in use, the piston rod 105 of the jack 104 will drive the jacking plate 106 outwardly (with respect to the housing 100) against the bias of the springs 112, and the floating plate 110 will follow by virtue of being tied to the jacking plate 106 by the connecting rods 108.

The jaws 150 will similarly follow the floating plate 110 by virtue of being tied to this.

As the jaws 150 are drawn downwardly within the housing 100 they arc simultaneously driven inwardly (by the sliding of the inclined planes 156 of the guide follower 154 over the inclined planes 146 of the jaw guides 144) to clamp upon any drill rod inserted therein.

Because there are there equi-spaced jaws 150, the clamping means is self-centering, so the drill rod (irrespective of diameter) will be centralised in the socket 100A. Moreover, because the jaws 150 are elongate, these clamp lengthwise along a portion of the drill rod, making for secure retention of the drill rod in the drill rod support 1.

When force provided by the jack 104 is removed, the springs 112 will bias the floating plate 110 upwardly, resulting in the return of the jaws 150 to their respective retracted, or home positions, and release of any drill rod in turn.

A vehicle supporting the drill rig 10 is generally configured so that drill rods are located in a bin lying alongside the drill mast 12.

When it becomes necessary to insert a new drill rod into position in a drill string, the drill rod support 1 can be positioned over an end of a drill rod lying in the bin. The clamping means is then activated (as described above) so that the end of the drill rod is secured in the drill rod support 1.

The second rotary actuator 26 is then actuated, causing the drill rod support 1 (and drill rod with it) to rotate into a substantially upright position with the innermost end of the tubular socket 1A lowermost and the drill rod extending upwardly from the socket 1A. With the drill rod so supported, the first rotary actuator 21 is then activated to cause the base plate 23 to move until the drill rod is substantially in alignment with the centreline of the drill head 14 and therefore the drill string. The support 23 can then be raised by the linear actuator 15 to cause the drill rod to be raised until its uppermost end becomes engaged with an adapter sub 13 with a lowermost tapered end 13*a* (to aid alignment) depending from the drill head 14. Once the upper end of the drill rod is engaged with the adapter sub 13, the clamping means in the drill rod support 1 are released and the drill rod support 1 can be lowered away from the drill rod and returned to a home position. The lower end of the drill rod is then lowered to the drill string with the guidance of a lower guide 16 (to aid alignment), and then engaged with the drill string, whereupon drilling can recommence.

When it becomes necessary to remove a length of drill rod from the drill string, the lower end of the drill rod is disengaged from the drill string and the drill rod is then raised with the drill head 14. The drill rod support 1 is then positioned so that the lower most end of the drill rod can be received within the tubular socket 1A of the drill rod support 1. The clamping means is then activated (as described above) so that the end of the drill rod is secured in the drill rod support 1. Once the drill rod has been so secured by the drill rod support 1, the upper end of the drill rod is disengaged from the drill head 14. The drill rod can be then lowered by lowering the base plate 23 in order that the upper end of the drill rod clears the drill head 14. The drill rod is then carried by the drill rod support 1 to a position beside the drilling mast 12 and is lowered to a horizontal position at which the clamping means in released so that the drill rod can be deposited into the bin.

It will be apparent from all of the above, that the drill rod support 1 disclosed herein can accommodate drill rods of various sizes, and retain drill rods of various sizes securely. Moreover, it will be apparent that a handling means comprising the drill rod support can position drill rods of various sizes relative to a drill string (and drill head), with a high degree of positional accuracy and no (or at least minimal) misalignment relative to the drill string and drill head.

Throughout the specification and the claims that follow, unless the context requires otherwise, the words "comprise", and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A drill rod support for handling drill rods, the support comprising:

a socket configured to receive a portion of a length of a drill rod;

a plurality of radially equi-spaced jaw slots formed into and extending lengthwise along an inner wall of the socket, each of the jaw slots including a lengthwise extending jaw guide having spaced apart inclined planes;

a clamping means disposed within the socket and movable between clamping and release positions with respect to the drill rod, the clamping means including a plurality of movable jaws, one jaw being located in each of the equi-spaced radially jaw slots within the socket, each of the jaws including a gripping face and a guide follower having spaced apart inclined planes located on a side opposite the gripping face, the inclined planes of the guide follower bearing against the oppositely directed but similarly inclined planes of the jaw guide of the slots;

a linear actuator for driving the jaws, wherein each jaw is biased towards the release position by a biasing means, the linear actuator being arranged to drive each movable jaw into its clamping position as it is driven against the bias of the biasing means into the clamping position and to drive a jacking plate against the bias of the biasing means;

an elongate cylindrical housing defining the socket internally, wherein one end of the housing is open and an opposing end is closed by an end plate to which the linear actuator is attached; and a floating plate linked to the jacking plate by at least one connecting rod extending therebetween, such that the floating plate will follow the movement of the jacking plate and wherein the jaws follow the movement of the floating plate, wherein the biasing means includes a compression spring disposed over each of the at least one connecting rod and between the jacking plate and the floating plate so as to maintain a predetermined spacing between the jacking plate and the floating plate, wherein the end plate is positioned between the floating plate and the jacking plate.

2. The drill rod support of claim 1, wherein the clamping means includes three radially equi-spaced jaws.

3. The drill rod support of claim 1, wherein the socket and each jaw is elongate, each having a direction of elongation which is substantially parallel to the other.

4. The drill rod support of claim 1, wherein the clamping means is self-centering, and as such always clamps the rod centrally with respect to the socket.

5. The drill rod support of claim 1, wherein a guide follower is operatively associated with a respective jaw guide disposed in the socket to drive the jaw into its clamping position as it is driven against the bias of the biasing means.

6. The drill rod support of claim 5, wherein each inclined plane of the guide follower is arranged to slide smoothly against an oppositely directed, but similarly inclined plane of the jaw guide with any longitudinal movement driven by the linear actuator.

7. A handling means for drill rods comprising:

a base; and a drill rod support including a socket configured to receive a portion of a length of a drill rod, a plurality of radially equi-spaced jaw slots being formed into and extending lengthwise along an inner wall of the socket, each of the jaw slots including a lengthwise extending jaw guide having spaced apart inclined planes, and a clamping means disposed within the socket and movable between clamping and release positions with respect to the drill rod, wherein the drill rod support is arranged so as to be so movable with respect to the base to effect movement of a length of drill rod, the clamping means including a plurality of movable jaws, one jaw being located in each of the equi-spaced radially jaw slots within the socket, each of the jaws including a gripping face and a guide follower having spaced apart inclined planes located on a side opposite the gripping face, the inclined planes of the guide follower bearing against the oppositely directed but similarly inclined planes of the jaw guide of the slots, and a linear actuator for driving the jaws, wherein each jaw is biased towards the release position by a biasing means, the linear actuator being arranged to drive each movable jaw into its clamping position as it is driven against the bias of the biasing means into the clamping position and to drive a jacking plate against the bias of the biasing means, an elongate cylindrical housing defining the socket internally, wherein one end of the housing is open and an opposing end is substantially closed by an end plate from which the linear actuator depends, and a floating plate linked to the jacking plate by at least one connecting rod extending therebetween, such that the floating plate will follow the movement of the jacking plate and wherein the jaws follow the movement of the floating plate, wherein the biasing means includes a compression spring disposed over each of the at least one connecting rod and between the jacking plate and the floating plate so as to maintain a predetermined spacing between the jacking plate and the floating plate, wherein the end plate is positioned between the floating plate and the jacking plate.

* * * * *